United States Patent [19]

Tulasne

[11] Patent Number: 4,635,825

[45] Date of Patent: Jan. 13, 1987

[54] INSTALLATION FOR AUTOMATICALLY DISPENSING, ON REQUEST, INDIVIDUAL PORTIONS OF DRINKING YOGHURT IN SELECTED FLAVORS

[75] Inventor: Jacques Tulasne, Paris, France

[73] Assignee: Societe de Developpements et d'Innovations des Marches Agricoles, Paris, France

[21] Appl. No.: 719,426

[22] Filed: Apr. 3, 1985

[30] Foreign Application Priority Data

Apr. 3, 1984 [FR] France ..... 84 05221

[51] Int. Cl.[4] ..... B67D 5/56

[52] U.S. Cl. ..... 222/129.1; 222/135; 222/145; 222/148; 141/90; 141/91; 141/104; 141/105; 366/177; 239/432; 239/413; 239/417.5

[58] Field of Search ..... 222/129.1–129.4, 222/135, 145, 148; 141/89, 90, 91, 104, 105, 107; 99/452; 366/160, 161, 177, 162; 239/432, 433, 413, 416.1, 417.5; 137/238, 240

[56] References Cited

U.S. PATENT DOCUMENTS 2,716,507 8/1955 Graves ..... 222/129.2
3,884,388 5/1975 Holcomb ..... 239/433 X
3,945,536 3/1976 Doak ..... 222/148
4,218,014 8/1980 Tracy ..... 222/145 X
4,465,210 8/1984 Iwanami ..... 222/148

FOREIGN PATENT DOCUMENTS 2133086 7/1984 United Kingdom ..... 222/129.1

*Primary Examiner*—Joseph J. Rolla
*Assistant Examiner*—David H. Bollinger
*Attorney, Agent, or Firm*—Gifford, Groh, VanOphem, Sheridan, Sprinkle & Dolgorukov

[57] ABSTRACT

The installation comprises a static mixer (1) connected to receive yoghurt from a yoghurt store (4) and a flavoring from a selected flavoring store (8 to 10). The amount of yoghurt and flavoring dispensed is measured by appropriate metering pumps (11 to 14). The static mixer has a bottom outlet (1*a*) under which a beaker (20) is placed to receive a portion of flavored yoghurt. The beaker stands over a waste funnel (19) to catch drips and spills. A wash tank (22) is provided together with various feeds for rinsing and/or cleaning materials (27 to 28). The wash tank is connected via a pump (33) and a duct (31) to a spray head (34) in the yoghurt store (4). A thorough automatic rinse-wash-rinse cycle can be performed, whenever necessary. The rinse cycles are preferable open circuit cycles, and the wash cycle is preferably a closed circuit cycle.

11 Claims, 5 Drawing Figures

INSTALLATION FOR AUTOMATICALLY DISPENSING, ON REQUEST, INDIVIDUAL PORTIONS OF DRINKING YOGHURT IN SELECTED FLAVORS

The present invention relates to automatically dispensing, on request, individual portions of drinking yoghurt in selected flavors.

An installation of this kind is intended mainly for use in catering establishments to dispense yoghurt in beakers at the request of the consumer.

BACKGROUND OF THE INVENTION

Installations are known for dispensing individual portions of milk on request from water and milk powder (French published patent specification No. 2 435 933), for dispensing lemonade from soda water and fruit juice (Belgian published patent specification No. 522 453), for dispensing fruit juice from water and fruit juice (British published patent specification No. 2 116 058) and for dispensing coffee from water and ground coffee.

Dispensing individual portions of flavored drinking yoghurt presents specific problems which are different from the problems presented for dispensing the above-mentioned drinks, and in particular because of the following reasons:

the installation must be capable of operating with materials of different viscosities since the various flavoring liquids are not all of the same viscosity, and yoghurt also has a different viscosity;

the installation must be capable of operating with portions of flavoring which vary from one flavoring to another; and the installation must be capable of being cleaned automatically in a manner which is entirely reliable.

In addition, the installation must naturally be capable of properly preserving the foodstuffs used and of keeping them at top quality.

SUMMARY OF THE INVENTION

The present invention provides an installation for automatically dispensing, on request, individual portions of drinking yoghurt in selected flavors, said installation comprising a store of liquid yoghurt and inlets for flavorings, a static free flow mixer having feed inlets individually connected to the yoghurt store and to the flavoring inlets via respective feed ducts fitted with remotely controllable means to cause a portion of yoghurt to flow from the yoghurt store to the mixer and to cause a portion of a selected flavoring to flow from the corresponding flavoring inlet to the mixer, means for supporting a beaker in a position in which it can receive the mixture leaving the mixer, and a device for cleaning the installation, the mixer comprising a body which defines an inside chamber having a central vertical feed duct terminating therein and connected to the yoghurt store and sloping inlet ducts angularly disposed around the central duct and connected to respective ones of the flavoring inlets, the wall of the chamber or deflectors placed inside the chamber ensuring that the fluid flows therein cross one another, and the mixer chamber having a plurality of sloping outlet orifices or ducts distributed to prevent the incident yoghurt or the incident flavoring from penetrating directly into one of said outlet orifices, and the device for cleaning the installation comprising a wash tank and means for feeding said tank in controlled manner with rinsing and/or cleaning materials, said tank being provided with an outlet connected to a duct which opens out in the yoghurt store and which includes means for causing fluid to flow from the tank to the yoghurt store, said tank further including an inlet fed from the outlet of the mixer, and the installation finally including means for connecting the tank to waste disposal means.

Cleaning generally comprises the following cycle:

the circuits are open cycle water rinsed, i.e. they are rinsed with water that is lost down the drain;

closed cycle hot washing using a cleaning fluid; and open cycle water rinsing.

Such an installation makes it possible to fill the beaker with a mixture of yoghurt and a selected flavoring on request, and to clean the yoghurt circuit on request as is required for reasons of hygiene and of taste.

BRIEF DESCRIPTION OF THE DRAWINGS

An embodiment of such an installation is described by way of example with reference to the accompanying drawings, in which.

MORE DETAILED DESCRIPTION

The installation essentially comprises a liquid yoghurt store, stores for flavorings, a mixer, a wash tank, and various circuits therebetween.

Figure 1:
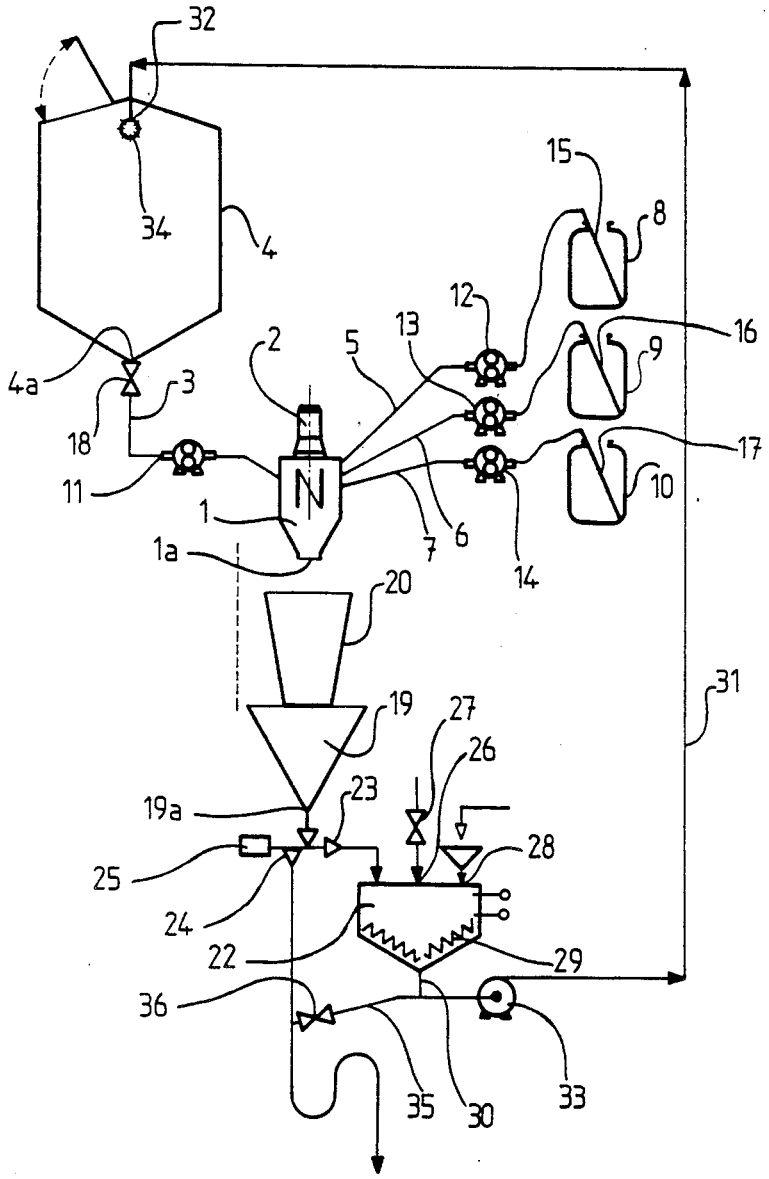
FIG. 1 is an overall diagram of the installation.

In FIG. 1, the chamber 1 of the mixer 2 is connected via a duct 3 to a refrigerated store 4 for containing liquid yoghurt, and via three separate ducts 5, 6, and 7 to three respective refrigerated stores 8, 9, and 10 for containing flavorings based on the pulp of different fruits. The flow of yoghurt and of the various flavorings is controlled by individual metering pumps 11 to 14.

The store 4 is refrigerated, for example, by an outside coil 54 (see FIG. 4) through which a cooling liquid flows from a conventional refrigeration circuit (not shown). The flavoring stores may be cooled, for example, by placing them in the immediate vicinity of the coil 54.

Figure 4:
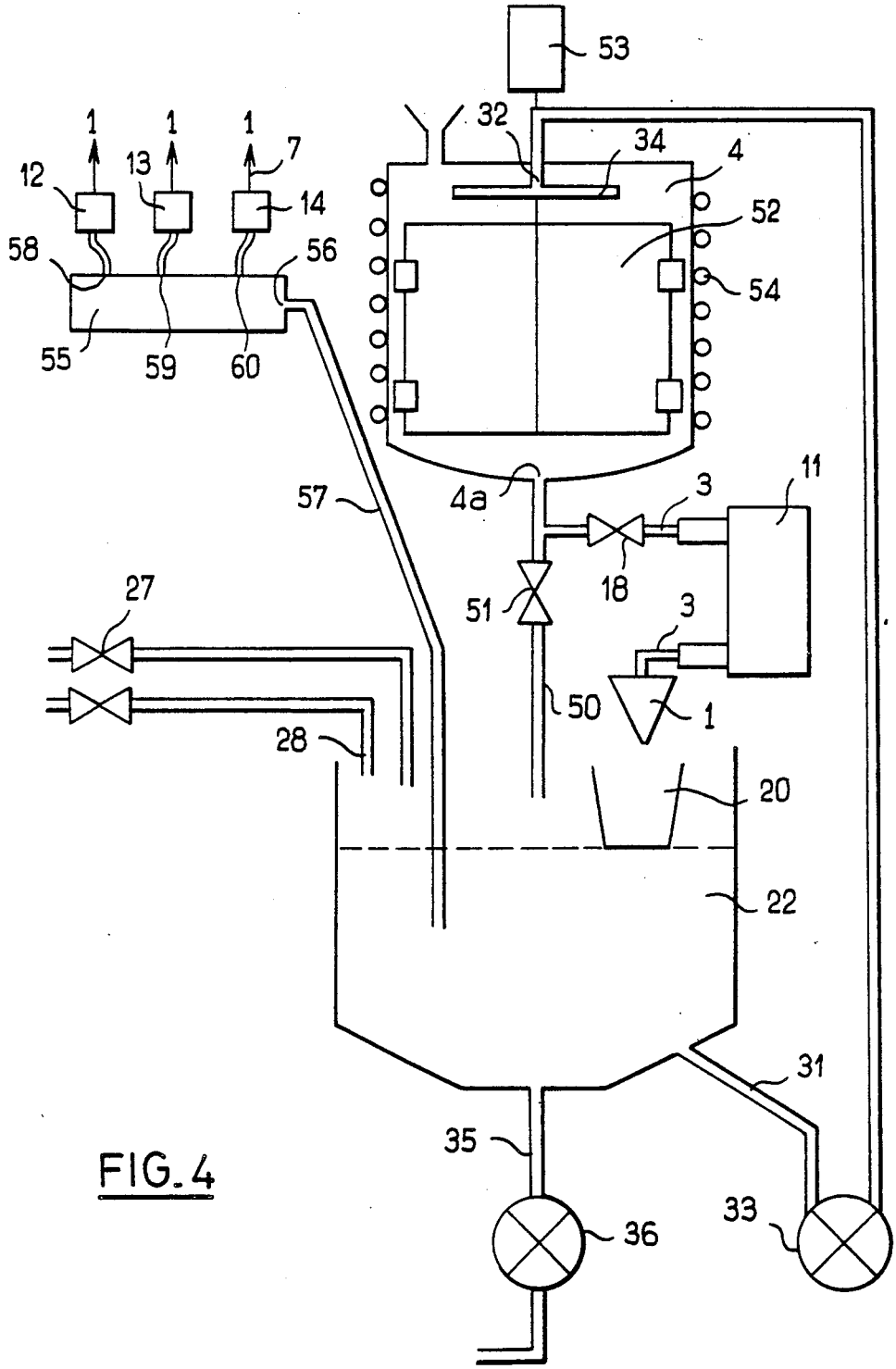
FIG. 4 is a diagram of a variant washing circuit.

The store 4 is preferably provided with a stirrer 52 which is driven circularly by a motor 53 (see FIG. 4).

The number of flavoring stores may be chosen at will.

The flavorings are preferably removed, as shown, from their respective stores 8, 9, and 10 by respective dip pipes 15, 16, and 17 connected to the ducts 5, 6, and 7. Other means could alternatively be used.

The yoghurt store is preferably provided, as shown, with a yoghurt outlet **4*a* disposed at the bottom thereof and connected to the duct 3 via an electrically controlled valve 18**. Other means could alternatively be used.

The mixer chamber 1 has a bottom outlet **1*a* opening out above a beaker 20 so that the contents of the chamber, is received in the beaker 20**.

In the example shown, the beaker 20 is placed over a waste collector 19 which has a waste outlet **19*a* that is connected both to a wash tank 22 via a valve 23, and to a waste pipe via a valve 24. The valves 23 and 24 may be constituted by separate members or they may be constituted by respective paths through a two-path tap. The outlet 19*a* may be a single outlet or it may comprise two outlets, one of which is connected to the wash tank, and the other of which is connected to the waste pipe. The valves 23 and 24 may be manually operated, or they may be under electrical or pneumatic control 25**.

In a variant embodiment, the beaker 20 is placed directly over the wash tank 22.

The wash tank 22 includes an inlet 26 through which it is supplied with water via a valve 27, together with one or more inlets 28 for supplying one or more washing fluids. Resistance elements 29 are disposed if required to heat the contents of the wash tank.

The wash tank 22 includes an outlet 30 which is connected via a duct 31 to an outlet disposed at the top of the store 4. A pump 33 pumps the contents of the wash tank 22 into the duct 31 and up to the outlet 32 which may be fitted with a spray nozzle arm 34. Another duct 35 under the control of a valve 36 connects the wash tank outlet 30 (or a second outlet therefrom) to a waste pipe.

The installation preferably includes means for rapidly emptying the yoghurt store 4 without having to pass through the pump 11 and the mixer 2. These means may comprise, for example, a duct 50 under the control of an electrically controlled valve 51 (see FIG. 4).

The installation preferably includes a circuit for washing the flavoring circuits.

In the example shown in FIG. 4, such a washing circuit comprises a manifold 55 having an inlet 56 connected via a duct 57 to the tank 22 and outlets 58, 59, and 60 suitable either to be connected to the dip pipes 15, 16, and 17 or else to be connected to the ducts 5, 6, and 7 (after temporarily detaching the dip pipes). By operating the pumps 12, 13, and 14, the contents of the tank 22 are sucked up the duct 57, into the manifold 55, into the ducts 5 to 7, and through the pumps 12 to 14 to pass into the mixer 2 and thus return to the tank 22.

Figure 2:
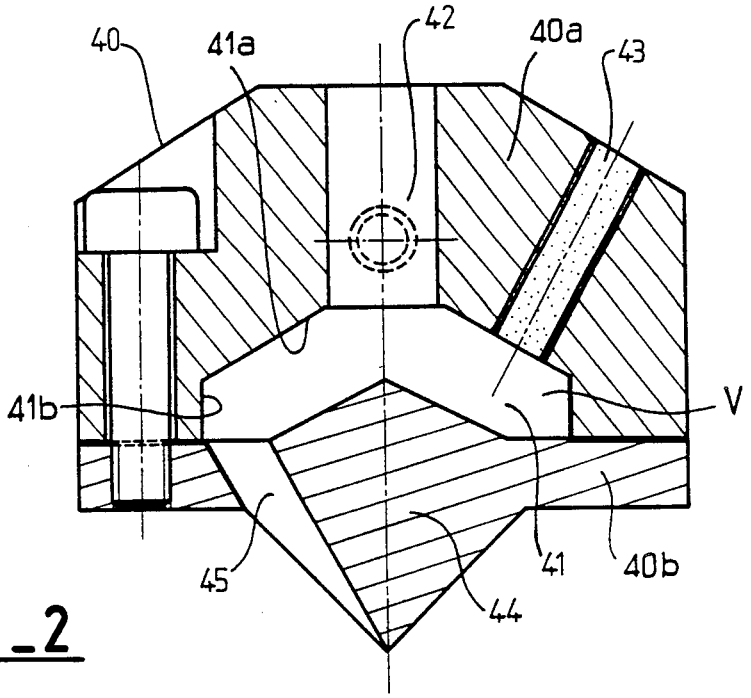
FIG. 2 is a vertical section through the mixer.
Figure 3:
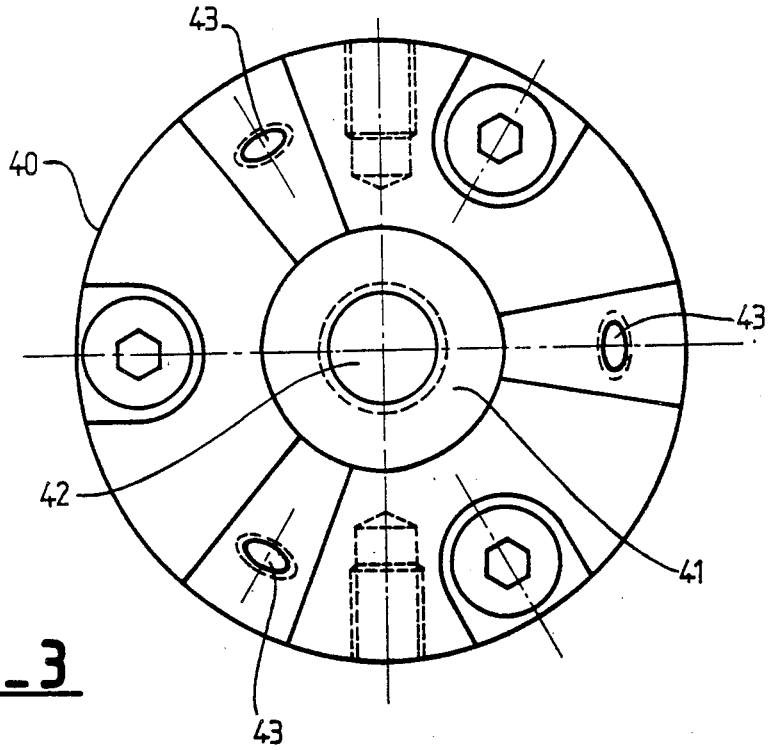
FIG. 3 is a plan view of the mixer.

The mixer 2 is a free flow mixer, with the fluids to be mixed being injected into the mixer 2 in directions or paths that cause them to be mixed without using mechanically driven parts. It is constituted (see FIGS. 2 and 3) by a body 40 which defines an inside chamber 41 having volume V and into which a vertical central feed duct 42 opens out. This duct is connected to the yoghurt supply. Sloping ducts 43 are angularly distributed around the vertical central duct 42 and are connected to respective ones of the flavoring stores. The wall 44 of the chamber 41, or else deflectors placed in the chamber 41, cause the fluid flows to cross one another and sloping outlet ducts or orifices 45 for delivering the mixture from the chamber 41 are disposed in such a manner as to prevent the incident yoghurt or the incident flavoring from escaping directly therethrough.

The body 40 preferably comprises two circularly symmetrical parts **40*a* and 40*b*, as shown, which are placed one against the other and which are removably fastened to each other. The part 40*a* defines a cap on chamber 41, said cap having a downwardly directed recess in its bottom with a sloping surface 41*a* flaring down to a cylindrical surface 41*b*. The other part 40*b* constitutes a closure member which closes the chamber 41 and which has a central conical projection 44 which is coaxial with the cylindrical surface 41*b* and which occupies the middle of the chamber 41** without coming into contact with the walls thereof.

The cap part **40*a* has a central axial bore 42 which leads to the narrow end of the recess and which is coaxial with the conical projection 44, together with three sloping inlet bores 43 which are at 120° intervals around the central bore 42 and which open out in the flared wall 41*a* of the recess opposite the sloping wall of the central conical projection 44**.

The closure member **41*b* has three sloping outlet bores 45 at 120° intervals around the conical projection 44, with each outlet bore 45 being substantially diametrically opposite an inlet bore 43**.

Figure 5:
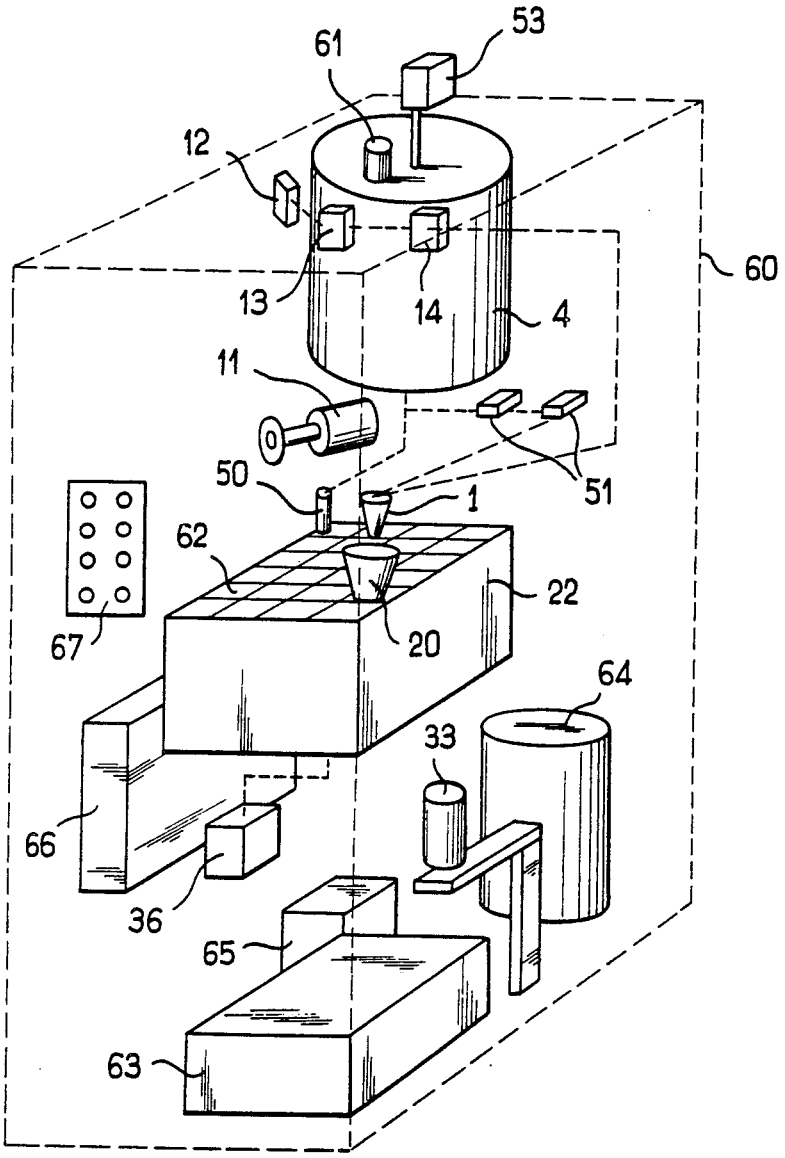
FIG. 5 is a diagram of a dispenser machine including a dispenser installation in accordance with the invention.

The installation as a whole is preferably contained in a rectangular cabinet 60 (see FIG. 5). The yoghurt store 4 is located at the top so as to be accessible via a filling opening 61 provided in the top of the cabinet.

The metering pumps 12 to 14 for the flavorings are located close to the store 4, and the cabinet 60 also includes an accessible housing close to said store 4 for receiving the flavoring stores (not shown in FIG. 5). The cabinet 60 includes a window to enable a beaker to be filled to be placed on a tray 62 under the mixer 1 shown in FIG. 5. The tray 62 has a multiplicity of holes passing therethrough, and it is placed on top of the wash tank 22. Means for providing refrigeration and for controlling the pumps and the electrically operated valves are located inside the cabinet 60 underneath the wash tank 22. These means include a refrigerator group 63, a supply of compressed air 64, an air compressor 65, an electrical box 66, a wash cycling pump 33 and a wash emptying pump 36. A control panel 67 is situated at some suitable height, e.g. level with the tray 62.

The consumer or the operator of the installation presses the controls, e.g. after inserting a coin to activate the controls, and causes one of the metering pumps 12 to 14 to be turned on at the same time as the pump 11, thereby sending one (or more) portion(s) of liquid yoghurt to the mixer together with one (or more) portion(s) of selected flavoring. These portions are automatically mixed by the mixer and they are automatically emptied into the beaker 20 which the customer or operator should have previously placed under the mixer. The pumps and the corresponding circuits are adjusted in such a manner that yoghurt admission to the mixer does not stop until after flavoring admission has stopped.

Appropriate safety devices may be provided to prevent the mixture from leaving the mixer unless a beaker is in place, in a manner known per se. From time to time the operator of the installation proceeds to clean the store 4, the yoghurt circuit, and the flavoring circuits. Such cleaning includes one or more rinsing stages.

The cleaning is performed automatically by filling the wash tank with one or more rinsing fluids and with one or more cleaning fluids, and by spraying these fluids inside the store 4 by means of the duct 31. The operator can make the fluids circulate round a closed cycle or send them to waste by operating the pumps and the valves.

The washing method used is chosen as a function of the materials to be washed away, and may include inserting acidic or basic materials into the wash tank.

After washing, overall rinsing is provided by putting water into the wash tank 22.

In accordance with one aspect of the invention, it has been established that in order to obtain thorough mixing of the yoghurt and the flavoring, the internal volume V of the mixer should be less than 10% of the volume of the portion to be dispensed, and better still, should lie in the range 3% to 8% of said volume. Further, in order to ensure that the flavoring is completely eliminated from the mixer, the flavoring should be passed through the mixer for about ⅔ of the time the yoghurt is passed therethrough.

For example, to dispense a portion of about 250 milliliters (ml), a mixer should be used having an internal volume of about 12 ml to 15 ml.

A 250 ml portion comprises 244 ml of yoghurt and 6 ml of flavoring. The total dispensing time is about 3 seconds, so the flavoring should be dispensed for about 2 seconds.

The viscosity of the flavoring is preferably adjusted to be less than 1500 centipoises (as determined at 4° C. using a Brookfield RVT viscosity meter at speed 10 modulus 1).

Having thus described my invention, many modifications thereto will become apparent to those skilled in the art without deviating from the scope of the appended claims.

I claim:

1. An installation for automatically dispensing, upon request, individual portions of drinking yoghurt in selected flavors, said installation comprising:

a store of liquid yoghurt having duct means leading therefrom and yoghurt control means for causing a portion of yoghurt to flow from said store;

at least one flavoring store having respective flavoring duct means leading therefrom and respective flavoring control means for causing a portion of flavoring to flow from said at least one flavoring store;

a static, free flow mixer comprising a body which defines an inside chamber having an inlet terminating therein and connected to the yoghurt store via said duct means and said yoghurt control means, a plurality of inlet ducts connected to respective ones of the at least one flavoring store via respective ones of said flavoring duct means and said flavoring control means, said inside chamber further having a plurality of outlet orifices, wherein said inlet, said inlet ducts and said outlet orifices are arranged so that the yoghurt and flavoring entering the chamber are mixed together before leaving the chamber through one of said outlet orifices;

means for supporting a beaker in a position in which it can receive the yoghurt and flavoring mixture leaving the outlet orifices of said mixer; and a device for cleaning the installation, said device comprising a wash tank having an outlet connected to said yoghurt store and an inlet connected to the outlet orifices of the mixer, means for supplying said wash tank in a controlled manner with cleaning material, means for pumping said cleaning material from the tank to the yoghurt store, and means for connecting the tank to waste disposal means.

2. An installation as defined in claim 1, wherein said device for cleaning the installation further comprises a manifold having an inlet connected to the wash tank and having at least one outlet connected to respective ones of said flavoring duct means.

3. An installation as defined in claim 1, wherein said mixer body further comprises two circularly symmetrical parts which are releasably secured one above the other, the first of said parts defining a recess having a flared surface leading to a cylindrical surface and an opening, said inside chamber being formed when the second of said parts, a closure member, is applied to the opening of the recess, said second part comprising a central conical projection extending into the inside chamber coaxial with said opening.

4. An installation as defined in claim 3, wherein said inlet comprises an axial bore in said first part, opening into the recess, coaxial with and opposite the apex of the conical projection, and said inlet ducts comprise angular bores distributed around said axial bore and opening into the flared surface of the recess opposite the surface of the conical projection.

5. An installation as defined in claim 4, wherein said outlet orifice comprise sloping bores disposed in said second part around the conical projection, each outlet orifice being substantially diametrically opposite an inlet duct.

6. An installation as defined in claim 1, wherein said inside chamber of the mixer has a volume which is less than ten percent of the volume of a yoghurt portion to be dispensed.

7. An installation as defined in claim 6, wherein said volume of the inside chamber is in the range of three percent to eight percent of the volume of the yoghurt portion to be dispensed.

8. An installation as defined in claim 1, wherein the flavoring duct means comprise duct pipes suitable for insertion into individual flavoring stores.

9. An installation as defined in claim 1, wherein said means for supporting a beaker comprises a tray which forms a cover for the wash tank.

10. An installation as defined in claim 1, wherein said installation is contained in a generally rectangular cabinet with the yoghurt store and the flavoring stores being located in close proximity to one another near the top of said cabinet to provide easy access for filling from above the cabinet, and for efficient refrigeration by means of a refrigerating coil surrounding at least said yoghurt store.

11. An installation as defined in claim 1, wherein said mixer body further comprises deflectors disposed within the inside chamber for enhancing the mixing of yoghurt and flavoring prior to the exit thereof from said inside chamber.

* * * * *

UNITED STATES PATENT AND TRADEMARK OFFICE

CERTIFICATE OF CORRECTION

PATENT NO. : 4,635,825

DATED : January 13, 1987

INVENTOR(S) : Jacques Tulasne

It is certified that error appears in the above-identified patent and that said Letters Patent is hereby corrected as shown below:

On the first page, in the name of Assignee, after "Agricoles," insert --et Alimentaires - SODIMA--.

Signed and Sealed this

Tenth Day of November, 1987

*Attest:*

DONALD J. QUIGG

*Attesting Officer*

*Commissioner of Patents and Trademarks*